US007370559B2

(12) United States Patent
Kamo et al.

(10) Patent No.: US 7,370,559 B2
(45) Date of Patent: May 13, 2008

(54) PNEUMATICALLY OPERATED SCREW DRIVER

(75) Inventors: Takeshi Kamo, Hitachinaka (JP); Akira Uno, Hitachinaka (JP); Michio Wakabayashi, Hitachinaka (JP); Haruhiko Oouchi, Hitachinaka (JP); Yasuo Sasaki, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 594 days.

(21) Appl. No.: 10/933,326

(22) Filed: Sep. 3, 2004

(65) Prior Publication Data

US 2005/0061847 A1 Mar. 24, 2005

(30) Foreign Application Priority Data

Sep. 19, 2003 (JP) ..... P2003-328228

(51) Int. Cl.
*B25B 13/00* (2006.01)

(52) U.S. Cl. ..... 81/57.44; 81/54; 81/57.42; 81/430; 81/433; 81/434

(58) Field of Classification Search ..... 81/54, 81/57.42, 57.44, 430, 433, 434, 53
See application file for complete search history.

(56) References Cited

U.S. PATENT DOCUMENTS 6,026,713 A * 2/2000 Ohmori et al. ..... 81/57.44
6,880,431 B2 * 4/2005 Wakabayashi et al. ..... 81/57.44

* cited by examiner

*Primary Examiner*—Joseph J. Hail, III
*Assistant Examiner*—Shantese L McDonald
(74) *Attorney, Agent, or Firm*—Antonelli, Terry, Stout & Kraus, LLP.

(57) ABSTRACT

A pneumatically operated screw driver ensuring a complete return of a piston to its top dead center. The screw driver has a compressed air return chamber for returning the piston to its top dead center by applying a compressed air in the return chamber to the piston. The piston includes a main piston and an auxiliary piston. The main piston is first reaches its bottom dead center, and then the auxiliary piston reaches its bottom dead center whereupon screw driving is terminated. Before the auxiliary piston reaches its bottom dead center, and after the main piston moves past a predetermined position, a compressed air is introduced into the return chamber. After the main piston reaches the bottom dead center, application of the compressed air pressure in the return chamber to the auxiliary piston is prevented.

9 Claims, 4 Drawing Sheets

PNEUMATICALLY OPERATED SCREW DRIVER

BACKGROUND OF THE INVENTION

The present invention relates to a pneumatically operated screw driver providing an axially driving force by a piston and rotational force by a pneumatic motor for screwing a threaded fastener into a woody member or the like.

U.S. Pat. No. 6,026,713 discloses a pneumatically operated screw driver including a driver bit engageable with a groove formed in a head of the faster. The driver bit is connected to a piston which is driven in an axial direction of the drive bit upon application of a pneumatic pressure to one side of the piston. Further, a pneumatic motor is provided for rotating the piston about its axis. Thus, the driver bit is axially movable while being rotated about its axis for screwing the fastener into a target. Further, a bumper is provided so as to absorb kinetic energy of the piston moving to its bottom dead center. An operation valve associated with a trigger is provided for opening a main valve in order to apply pneumatic pressure onto the piston.

The disclosed screw driver also includes a return chamber to which a compressed air is accumulatable for applying compressed air to the piston in order to move the piston and the driver bit to their initial positions. More specifically, accumulation of the compressed air into the return chamber is started when the piston is about to reach its bottom dead center. When the screw fastening operation is terminated upon abutment of the piston onto the bumper, the compressed air accumulated in the return chamber will be applied to an opposite side of the piston so as to return the piston and the driver bit to their original positions.

SUMMARY OF THE INVENTION

The present inventors have found disadvantages in the conventional screw driver such that the piston and the driver bit do not sufficiently return to their original positions, if the trigger is released before a predetermined amount of compressed air is accumulated in the return chamber after completion of screw driving operation, or if the piston has not reached the bottom dead center due to insufficient screw driving operation, for example due to accidental disengagement of the driver bit from the head of the fastener. Such drawback occurs because the accumulation of the compressed air into the return chamber is started when the piston reaches its bottom dead center at a timing immediately before completion of the screw driving operation.

A supply of the compressed air into the return chamber may be started before the piston reaches its bottom dead center in an attempt to improve returning motion of the piston. However in the latter case, compressed air in the return chamber is flowed into a driver bit side of the piston. Therefore, the flowed compressed air resists movement of the piston toward its bottom dead center, which in turn reduces a driving or thrusting force of the piston. Consequently accidental disengagement of the driver bit from the head of the fastener may easily occur.

It is therefore an object of the present invention to overcome the above-described problems and to provide an improved pneumatically operated screw driver ensuring complete return of the piston and the driver bit to their original positions yet performing complete screw driving operation without imparting resistance to the movement of the piston toward its bottom dead center.

This and other objects of the present invention will be attained by a main piston and an auxiliary piston those configured to ensure a return of the piston and a driver bit to their original positions.

More specifically, the present invention provides a pneumatically operated screw driver including an outer frame, a pneumatic motor, a cylinder, a main piston, a seal member, a bumper, and an auxiliary piston. The pneumatic motor is disposed in the outer frame and is rotatable about its axis. The cylinder is fixedly disposed in the outer frame and is formed with at least one compressed air introduction hole and at least one compressed air flowage hole. A return chamber is defined between the outer frame and the cylinder so that a compressed air is flowed from the cylinder to the return chamber through the air flowage hole and is flowed from the return chamber into the cylinder through the air introduction hole. The main piston is slidably disposed in the cylinder and is movable in an axial direction of the cylinder between its top dead center and a bottom dead center. The main piston is in a form of a sleeve like configuration defining an inner space and an outer space and is formed with a first communication hole permitting fluid communication between the inner space and the outer space. The main piston has an abutment end. The seal member is disposed at the main piston and in sealing contact with the cylinder. The bumper is disposed at the cylinder. The abutment end of the main piston is abuttable on the bumper. The auxiliary piston is movable in the axial direction between its top dead center and a bottom dead center and is rotatable about its axis by the rotation of the pneumatic motor. The auxiliary piston has a hollow section, an intermediate section, and another end portion provided with a piston section and a driver bit attaching portion. At least the intermediate section and the another end portion are disposed in the inner space of the main piston, and the piston section is slidably movable with respect to the main piston. A second communication hole is formed at the intermediate section in communication with the hollow section and the inner space of the main piston. The air flowage hole is positioned to allow compressed air in the compressed air in the inner space to direct into the return air chamber through the first communication hole after the seal member of the main piston moves past the air flowage hole during movement of the main piston toward its bottom dead center and after the piston section opens the first communication hole and before the auxiliary piston reaches its bottom dead center.

DETAILED DESCRIPTION OF THE PREFERRED EMBODIMENTS

Figure 1:
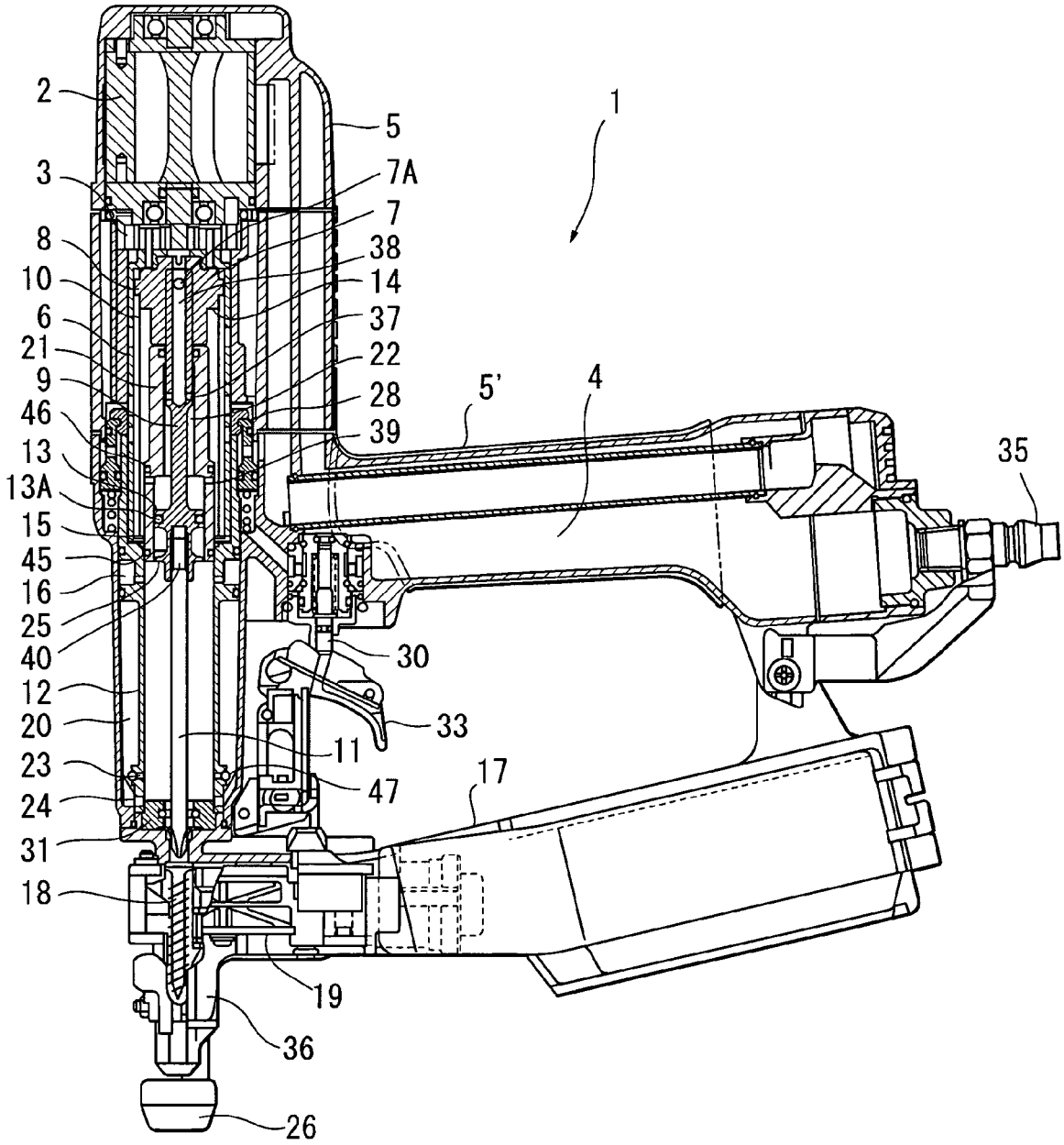
FIG. 1 is a partial cross-sectional side view showing an initial state of a screw driver according to one embodiment of the present invention.

A pneumatically operated screw driver according to an embodiment of the present invention will be described with reference to FIGS. 1 through 4. The directions used in the following description are defined based on a screw driver held in a vertical position with a driver bit extending downward and a grip extending rearward. Needless to say, the actual direction of the screw driver will be frequently changed due to its handiness when it is used.

A pneumatically operated screw driver 1 includes a body 5. The body 5 constitutes an outer frame of a main body. The body 5 includes a handle 5'. The body 5 has an inside space defining a compressed air chamber 4 extending from the handle 5' to an upper part of the body 5. The compressed air chamber 4 is in communication with an intake port 35 at the rear end of the handle 5' for introducing the compressed air. A trigger lever 33, an operation valve 30 opened or closed by the trigger lever 33, and a main valve 28 opened or closed by the operation valve 30 are provided at the body 5.

A pneumatic motor 2 is provided at the top of the body 5. The pneumatic motor 2 has a rotor rotatable about its axis when it receives the compressed air. The rotor engages a planetary gear unit 3 to transmit the speed-reduced rotation to a rotary member 6. The rotary member 6 causes a rotation in synchronism with the rotation of the rotor. The rotary member 6 is in a cylindrical shape having a bottom. The rotary member 6 is rotatably supported within the body 5.

The rotary member 6 has an inner peripheral surface formed with a pair of grooves 10 extending in an axial direction thereof. Within the rotary member 6, a rotation slide member 7 is disposed. The rotation slide member 7 has an upper portion from which a pair of projections 8 project and are slidingly engaged with the pair of grooves 10 for permitting the rotation slide member 7 to move in the axial direction relative to the rotary body 6. The rotation slide member 7 defines an air shielding surface 14.

A shaft 9 serving as an auxiliary piston extends in the longitudinal direction of the body 5. The shaft 9 has an upper end portion fixed to the rotation slide member 7 by a pin 7A, an intermediate portion, and a lower portion. In the upper end portion and the intermediate portion, an air supply bore 38 extending in the axial direction of the shaft 9 and small diameter holes 37 extending in a radial direction thereof and in communication with the air supply bore 38 are formed for supplying a compressed air to a piston section 13 described later.

At the lower portion of the shaft 9, a driver bit assembling section 40, the piston section 13, and a flange section 25 are provided. The driver bit assembling section 40 is disposed at the lower end portion of the shaft 9 for assembling a driver bit 11. The piston section 13 is disposed as an outer peripheral section of the shaft 9 at a position immediately above the driver bit assembling section 40. The piston section 13 has an outer peripheral surface provided with an O-ring 13A. The flange section 25 is disposed as an outer peripheral section of the shaft 9 at a position below the piston section 13 for determining the termination of screw fastening operation.

A cylinder 12 is disposed in the body 5 and extends in the axial direction of the shaft 9. A main piston 21 is slidably disposed in the cylinder 12. The main piston 21 is positioned below the rotation slide member 7 and is disposed to surround a part of the shaft 9. That is, a lower part of the upper end portion, the intermediate portion, and the lower portion of the shaft 9 are surrounded by the main piston 21. The main piston 21 has a hollow section 22 including a top end through which the shaft 9 extends, an upper hollow section, and a lower hollow section. An inner diameter of the upper hollow section is greater than an outer diameter of the shaft 9 and is smaller than an outer diameter of the piston section 13. An inner diameter of the lower hollow section is greater than the inner diameter of the upper hollow section for allowing the piston section 13 to be in sliding engagement. That is, the O-ring 13A is in sliding contact with the lower hollow section. Further, the flange section 25 has an outer diameter smaller than the inner diameter of the lower hollow section 22. Therefore, a minute annular space is defined between the flange section 25 and the lower hollow section 22.

An O-ring 45 in sliding contact with the inner peripheral surface of the cylinder 12 is assembled at a lower outer peripheral surface of the main piston 21. Further, another O-ring 46 in sliding contact with the inner peripheral surface of the cylinder 12 is assembled at the outer peripheral surface and above the O-ring 45. Piston holes 39 are formed in the main piston 21 at a position between the O-rings 45 and 46 for providing communication between an interior and exterior of the main piston 21. The piston holes 39 function as a first communication hole in the present invention.

The rotation slide member 7 has a communication hole open at its upper surface, and the air supply bore 38 is in communication with an interior of the rotary member 6 through the communication hole. The small diameter holes 37 is adapted to communicate the air supply bore 38 with an inner space of the main piston 21. The small diameter holes 37 function as a second communication hole in the present invention.

A plate section 15 is provided at an upper portion of the cylinder 12. The plate section 15 is adapted to permit the air shield surface 14 of the rotation slide member 7 to be brought into abutment therewith when the rotation slide member 7 is moved descent down by a predetermined distance. A vent hole 16 is formed below the plate section 15. The vent hole 16 is in communication with an air inlet opening (not shown) of the pneumatic motor 2 through an air passage (not shown).

A return chamber 20 is defined by a space between the lower portion of the body 5 and the outer peripheral surface of the cylinder 12. The lower portion of the cylinder 12 is formed with compressed air flowage holes 23 for introducing compressed air into the return chamber 20. A rubber ring 47 serving as a check valve is disposed over each outlet opening of the compressed air flowage holes 23 for preventing compressed air in the return chamber 20 to flow back into the cylinder 12. At the lower portion of the cylinder 12, a plurality of compressed air introduction holes 24 are formed at position below the compressed air flowage holes 23 for providing fluid communication between the return chamber 20 and the cylinder 12.

Figure 4:
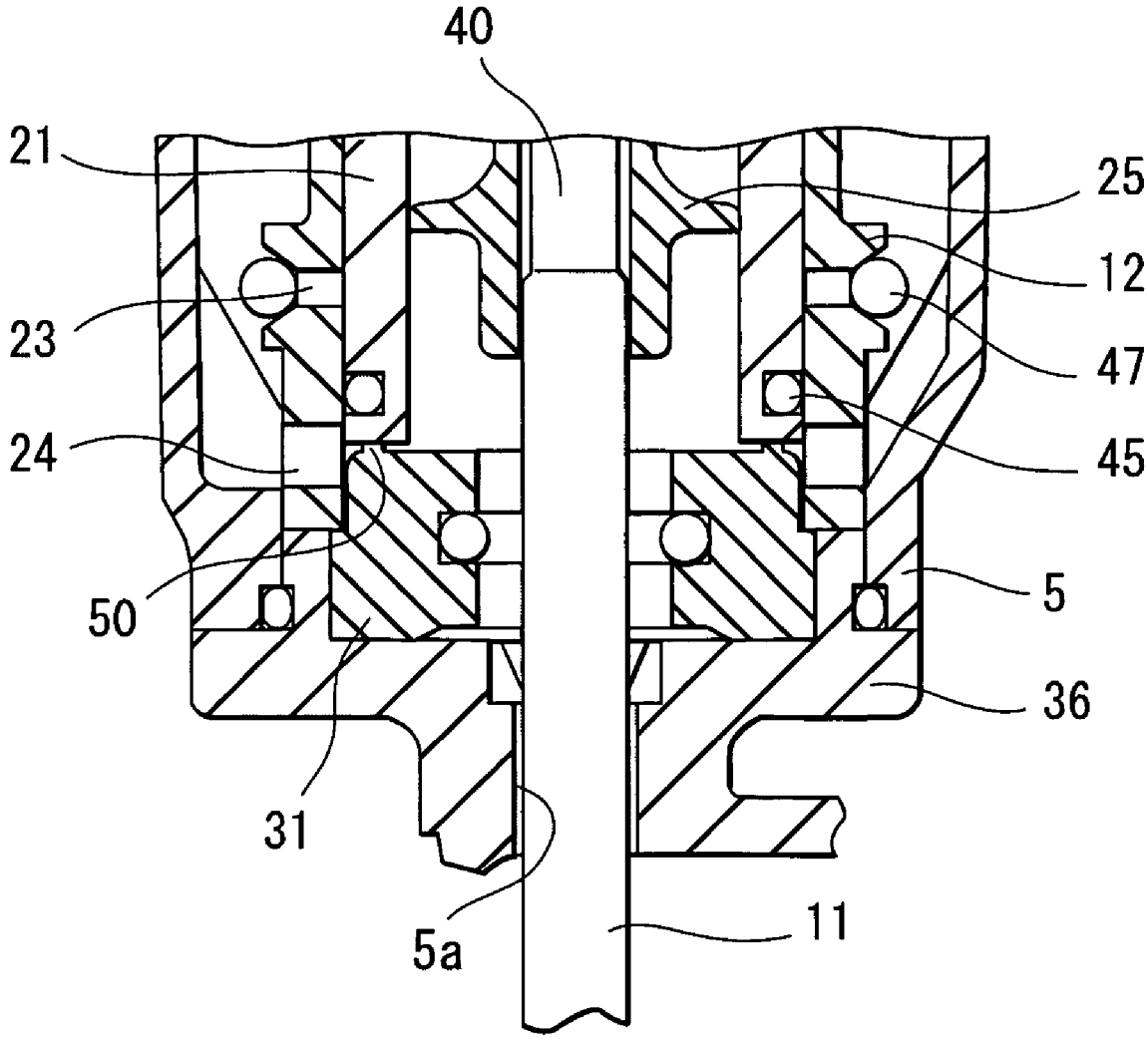
FIG. 4 is an enlarged cross-sectional view particularly showing a piston bumper of the screw driver in the phase shown in FIG. 2.

A piston bumper 31 is provided at the lower portion of the cylinder 12. A bottom surface of the main piston 21 and the flange section 25 of the shaft 9 bump against the piston bumper 31 when the main piston 21 and the shaft 9 reach their bottom dead centers. More specifically, as shown in FIG. 4, the piston bumper 31 is provided with an annular abutment projection 50 on which the bottom end of the main piston 21 will abuts. An outer diameter of the bottom end of the main piston 21 is slightly greater than an outer diameter of the abutment projection 50.

A hole 5*a* is formed at the lowermost portion of the body 5 for allowing a screw 18 and the driver bit 11 to pass therethrough. An inner diameter of the hole 5*a* is slightly greater than an outer diameter of the driver bit 11, so that a minute space is defined therebetween. This minute space serves as an air discharge passage through which an air within the cylinder 12 and below the piston section 13 can be discharged to the atmosphere during downward stroke of the piston section 13.

More specifically, in order to provide sufficient thrusting force or downward moving force of the piston section 13, a sufficiently large volume of air must be smoothly discharged through the minute space. Therefore, the minute space must be sufficiently large so as to facilitate this air discharge. On the contrary, the minute space must be sufficiently small so as to maintain sufficiently high pressure in the cylinder space below the piston section 13 in order to move back the shaft 9 upwardly after completion of fastener driving. The latter high pressure is supplied from the return air chamber 20 into the cylinder space below the piston section 13 through the compressed air introduction holes 24. Consequently, the area of the minute space is configured in an attempt to balance the conflicting requirements.

A nose portion 36 is provided to the lowermost portion of the body 5. A magazine 17 is connected to the body 5. The magazine 17 accommodates therein a plurality of screws arrayed side by side by an interlinking band (not shown). A screw feeder 19 is disposed in the magazine 17 and at a position adjacent to the nose portion 36 for automatically feeding a leading end screw of the screw array to the nose portion 36. A push lever 26 in interlocking relation to the operation valve 30 is provided at a position below the screw feeder 19.

Next, operation of the pneumatically operated screw driver thus constructed will be described.

In the screw driver, not only the operation valve 30 but also the push lever 26 are operated from the state shown in FIG. 1 so as to start driving operation. In this case, screw fastening can be achieved by pulling the trigger lever 33 after the push lever 26 is pushed against a workpiece (not shown), or by pressing the push lever 26 against the workpiece while the trigger lever 33 is being pulled.

When the compressed air intake port 35 is connected to a compressor (not shown), the compressed air is introduced into the compressed air chamber 4 and the operation valve 30. If the operation valve 30 is operated while the push lever 26 is pressed against the workpiece, the main valve 28 is opened, so that the compressed air is delivered into the rotary member 6 through the air passage (not shown). As a result, pneumatic pressure is applied to the upper surface of the main piston 21.

Further, pneumatic pressure is also applied to the upper surface of the piston section 13 of the shaft 9 because the compressed air can pass through the air supply bore 38 and the small diameter holes 37. Further, the compressed air leaked into a hollow space between the inner peripheral surface of the rotary member 6 and the outer peripheral surface of the main piston 21 is also applied to the upper surface of the piston section 13 through the piston holes 39 (see FIG. 1). Thus, the main piston 21 and the shaft 9 are urged downward.

If the descent movement of the piston section 13, i.e., the movement of the shaft 9 is decelerated due to the resistance incurred when the shaft 9 forcibly removes the screw 18 from the interlinking band, the main piston 21 catches up with the piston section 13 before the tip end of the screw 18 is driven into the workpiece. Consequently, the main piston 21 and the shaft 9 are integrally moved downwardly, so that the driver bit 11 drives the screw 18 into the workpiece. Incidentally, after the O-ring 46 of the main piston 21 starts sliding movement relative to the cylinder 12, compressed air through the piston holes 39 will not be applied to the upper surface of the piston section 13 of the shaft 9, because fluid passage from the piston holes 39 is blocked by the O-ring 46. In the latter case, the compressed air through the air supply bore 38 and the small diameter holes 37 will be applied to the upper surface of the piston section 13.

Immediately before the main piston 21 reaches its bottom dead center and when the O-ring 45 moves past the compressed air flowage hole 23, the compressed air flowage hole 23 starts flowing of the compressed air into the return chamber 20 through the air supply bore 38, the small diameter holes 37 and the piston holes 39. On the other hand, compressed air supplied into the rotary member 6 is supplied to the pneumatic motor 2 through the air vent hole 16 for rotating the pneumatic motor 2. The rotation of the pneumatic motor 2 is transmitted to the rotary member 6 and the rotation slide member 7 through the planetary gear unit 3.

Figure 2:
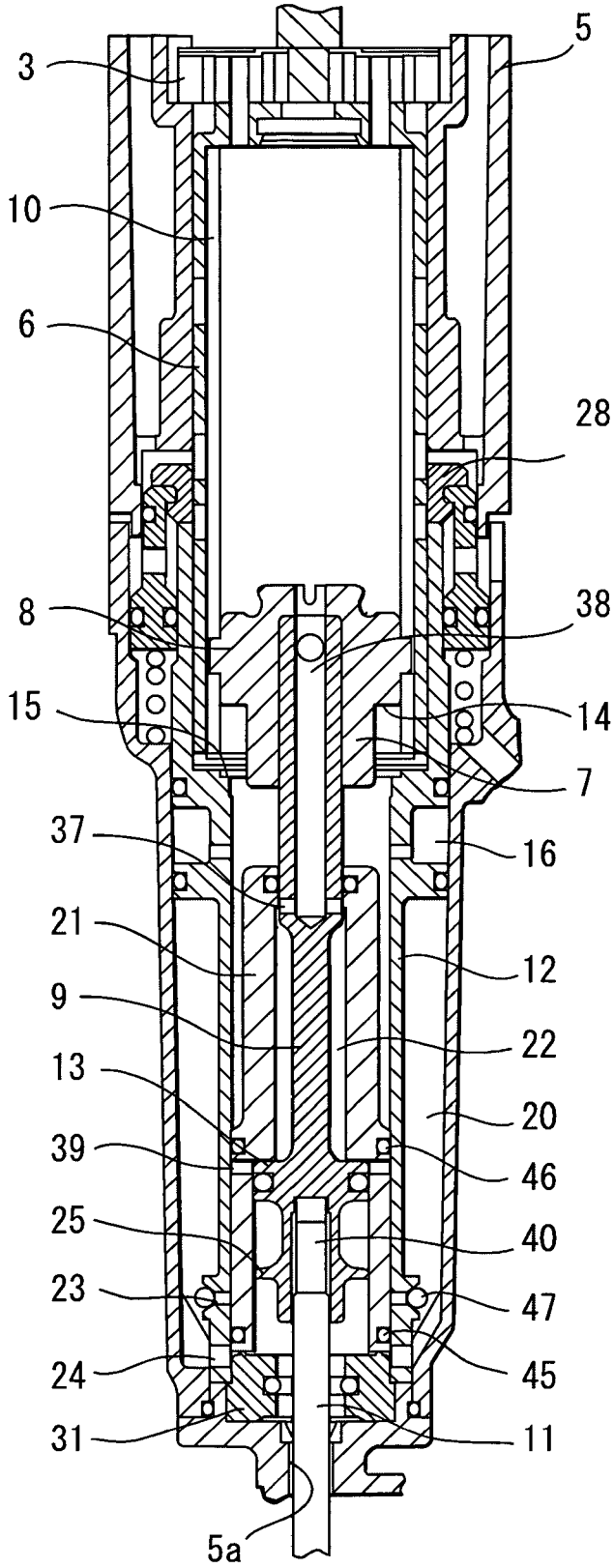
FIG. 2 is a cross-sectional side view showing an essential portion of the screw driver in its screw driving phase.

As shown in FIG. 2, after the main piston 21 reaches its bottom dead center, the driver bit 11 continues descent movement only by the thrust of the auxiliary piston, i.e., the shaft 9, so that the screw 18 can be screwed into the workpiece. In this case, since the bottom surface of the main piston 21, i.e., an abutment end of the main piston 21 is in intimate contact with the piston bumper 31, compressed air in the return chamber 20 cannot be entered into the lower space defined by the main piston 21 and the shaft 9. Consequently, the thrust of the piston section 13 can be maintained to avoid accidental disengagement of the tip end of the driver bit 11 from the screw head groove due to shortage of the thrust.

In this case, because the difference in the outer diameter of between the bottom end of the main piston 21 and the annular abutment projection 50 is small so as to provide a sufficiently small pressure application area at the bottom end of the main piston 21 for returning the main piston toward its top dead center, the main piston 21 can be maintained at the bottom dead center position even if the pressure level in the return chamber 20 is increased at the terminal phase of the screw fastening operation as long as the pressure level in the rotary member 6 is still sufficient to maintain the main piston to its bottom dead center.

Figure 3:
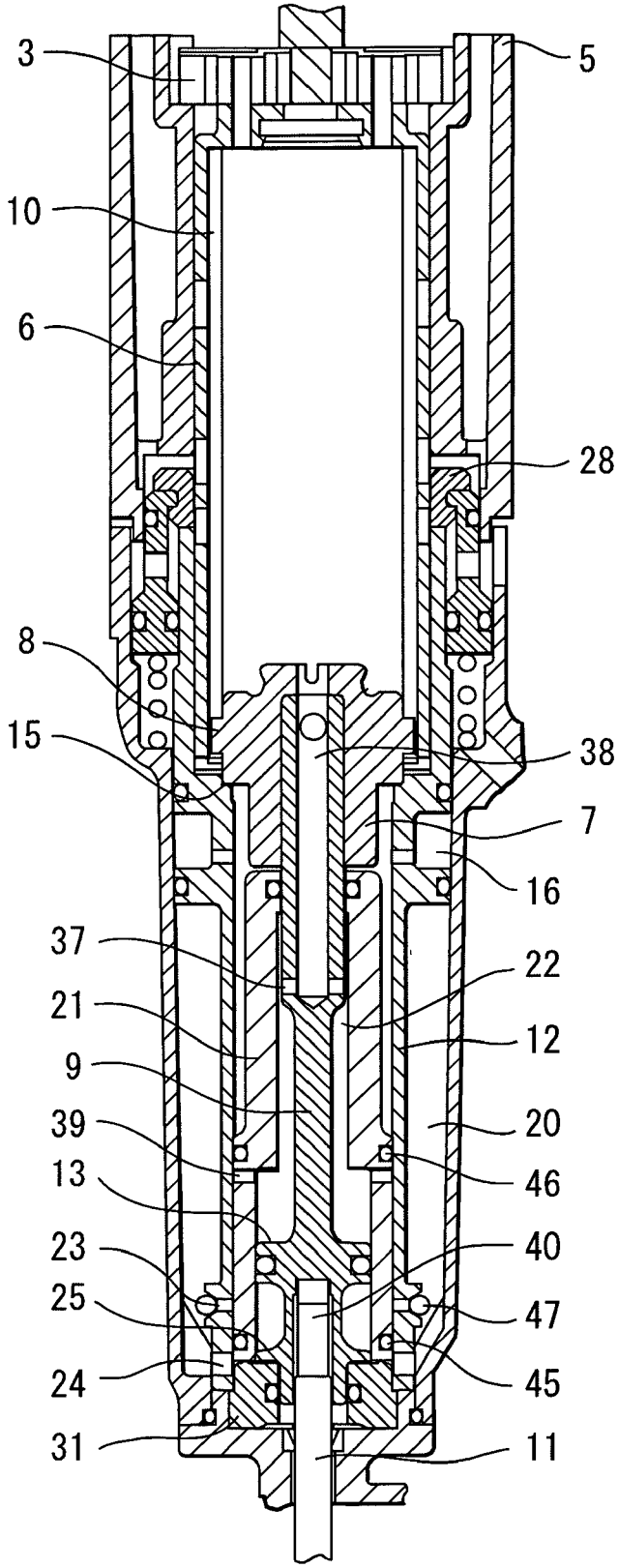
FIG. 3 is a cross-sectional side view showing the essential portion of the screw driver and showing just a completion phase of the screw driving operation.

When the screw 18 is fastened to a predetermined depth, the air shield surface 14 of the rotation slide member 7 abuts on the plate section 15 as shown in FIG. 3 to stop further descent motion of the rotation slide member 7. At the same time, the air communication between the rotary member 6 and the vent hole 16 will be blocked for stopping rotation of the pneumatic motor 2, thereby completing the screw driving operation. Moreover, when the flange section 25 is seated on the bumper 31, the shaft 9 cannot be any more moved to terminate the fastening operation.

Here, because the space between the hole 5*a* and the driver bit 11 is sufficiently small, a pressure in the cylinder 12 below the piston section 13 is gradually increased in accordance with the downward movement of the piston section 13. This pressure increase resists downward movement of the piston section 13. However, because the flange section 25 is disposed below the piston section 13 and the annular space is defined between the flange section 25 and the cylinder 12, internal volume in the cylinder 12 and below the piston section 13 is sufficient in comparison with a case where no flange section is provided and a piston section is provided at the position of the flange section. Because the sufficiently large volume is provided, the degree of pressure increase in the volume can be moderated, which permits the piston section 13 to be smoothly moved downwardly even at the terminal phase of the fastening operation.

If the operation valve 30 is released, compressed air in the rotary member 6 will be discharged to an atmosphere, and the compressed air in the return chamber 20 passes through the compressed air introduction hole 24 and is applied to the bottom face of the main piston 21 because as shown in FIG. 4 the outer diameter of the bottom end of the main piston 21 is slightly greater than the outer diameter of the abutment projection 50.

In accordance with the movement of the main piston 21, air shielding between the main piston 21 and the piston bumper 31 becomes invalid, so that the compressed air from the return chamber 20 will be applied to the lower side of the piston section 13. Therefore, the piston section 13 and the driver bit 11 are returned to their original positions when the internal pressure within the rotary member 6 becomes lowered. Simultaneously, a subsequent screw 18 is fed to a position in alignment with the driver bit 11 by the screw feeder 19, and then the main piston 21 and the shaft 9 return to their initial positions.

As described above, when the main piston 21 reaches its bottom dead center upon abutment with the projection 50 of the piston bumper 31, compressed air supply to the return chamber 20 is started, and this air supply to the return chamber 20 continues even during the screw fastening operation by means of the downward movement of the piston section 13. Further, the compressed air accumulated in the return chamber 20 does not enter the lower side of the piston section 13 because the main piston 21 is seated on the piston bumper 31.

Thus, the compressed air pressure from the return chamber 20 can be applied to the bottom face of the main piston 21 at a proper timing to ensure a return of the piston section 13 and the driver bit 11 to their original positions, even if the operation valve 30 is promptly released upon completion of the screw driving operation, or even if the piston section 13 has not yet reached to its bottom dead center due to insufficient screw fastening caused by accidental disengagement of the driver bit 11 from the screw head groove. Further, generation of accidental disengagement of the driver bit from the screw head groove due to unwanted application of the compressed air pressure from the return chamber 20 to the piston section 13 can be avoided.

While the invention has been described in detail with reference to specific embodiments thereof, it would be apparent to those skilled in the art that various changes and modifications may be made therein without departing from the spirit and scope of the invention.

What is claimed is:

1. A pneumatically operated screw driver comprising:

an outer frame;

a pneumatic motor disposed in the outer frame and rotatable about its axis;

a cylinder fixedly disposed in the outer frame and formed with at least one compressed air introduction hole and at least one compressed air flowage hole, a return chamber being defined between the outer frame and the cylinder so that a compressed air is flowed from the cylinder to the return chamber through the air flowage hole and is flowed from the return chamber into the cylinder through the air introduction hole;

a main piston slidably disposed in the cylinder and movable in an axial direction of the cylinder between its top dead center and a bottom dead center, the main piston being in a form of a sleeve like configuration defining an inner space and an outer space and being formed with a first communication hole permitting fluid communication between the inner space and the outer space, the main piston having an abutment end;

a seal member disposed at the main piston and in sealing contact with the cylinder;

a bumper disposed at the cylinder, the abutment end of the main piston being abuttable on the bumper; and an auxiliary piston movable in the axial direction between its top dead center and a bottom dead center and rotatable about its axis by the rotation of the pneumatic motor, the auxiliary piston having a hollow section, an intermediate section, and another end portion provided with a piston section and a driver bit attaching portion, at least the intermediate section and the another end portion being disposed in the inner space of the main piston, and the piston section being slidably movable with respect to the main piston, a second communication hole being formed at the intermediate section in communication with the hollow section and the inner space of the main piston, the air flowage hole being positioned to allow compressed air in the inner space to direct into the return air chamber through the first communication hole after the seal member of the main piston moves past the air flowage hole during movement of the main piston toward its bottom dead center and after the piston section opens the first communication hole and before the auxiliary piston reaches its bottom dead center.

2. The pneumatically operated screw driver as claimed in claim 1, wherein the outer frame has an inner peripheral surface and defines therein a compressed air space;

wherein the cylinder has an outer peripheral surface, an inner peripheral surface, one end, and another end, the at least one compressed air introduction hole being formed at the another end, and the at least one compressed air flowage hole being positioned near the another end, the return chamber being defined between the inner peripheral surface of the outer frame and the outer peripheral surface of the cylinder;

wherein the main piston is in a form of a sleeve like configuration and has an inner peripheral surface defining the inner space and an outer peripheral surface defining the outer space, and having one end, a longitudinally intermediate portion, and another end serving as the abutment end, the first communication hole being positioned at the intermediate portion;

wherein the seal member is disposed at the another end of the main piston and in sealing contact with the inner peripheral surface of the cylinder;

wherein the bumper is disposed at the another end of the cylinder; and wherein the auxiliary piston has one end portion provided with the hollow section in communication with the compressed air space, the piston section being slidably movable with respect to the inner peripheral surface of the main piston.

3. The pneumatically operated screw driver as claimed in claim 2, wherein the abutment end of the main piston is seated on the bumper for closing the inner space of the main piston against the return chamber through the air flowage hole.

4. The pneumatically operated screw driver as claimed in claim 2, further comprising an operation valve provided at the main frame for selectively discharging compressed air from the compressed air space.

5. The pneumatically operated screw driver as claimed in claim 4, wherein the abutment end has a first outer diameter, and wherein the piston bumper includes an annular abutment projection having a second outer diameter smaller than the first outer diameter.

6. The pneumatically operated screw driver as claimed in claim 5, wherein the air introduction hole is positioned adjacent to an abutment position between the abutment end and the annular abutment projection of the bumper.

7. The pneumatically operated screw driver as claimed in claim 2, wherein the first communication hole of the main piston is positioned closer to the one end of the cylinder than the air flowage hole to the one end of the cylinder.

8. The pneumatically operated screw driver as claimed in claim 2, wherein the one end of the main piston is closed to which a compressed air in the compressed air space is applied.

9. The pneumatically operated screw driver as claimed in claim 8, further comprising:

a rotary member rotatable about its axis by the rotation of the pneumatic motor, the rotary member defining an inner space serving as the compressed air space; and a rotation slide member slidably movable in the axial direction with respect to the rotary member and rotatable together with the rotation of the rotary member, the auxiliary piston being connected to the rotation slide member.

* * * * *